US005894000A

United States Patent [19]

Loy

[11] Patent Number: 5,894,000

[45] Date of Patent: Apr. 13, 1999

[54] ELECTRO-RHEOLOGICAL FLUID COMPOSITION HAVING POLYMERIC SPONGE PARTICULATES

[75] Inventor: Luke W. Loy, Washington, D.C.

[73] Assignee: The United States of America as represented by the Secratary of the Navy, Washington, D.C.

[21] Appl. No.: 07/953,340

[22] Filed: Sep. 30, 1992

[51] Int. Cl.[6] ..... C10M 171/00; C10M 169/04

[52] U.S. Cl. ..... 252/572; 252/73

[58] Field of Search ..... 252/572, 73

[56] References Cited

U.S. PATENT DOCUMENTS 4,129,513 12/1978 Stangroom ..... 252/78.1

4,502,973 3/1985 Stangroom ..... 252/73

4,690,825 9/1987 Won ..... 424/501

FOREIGN PATENT DOCUMENTS 1570234 6/1980 United Kingdom .

*Primary Examiner*—Christine Skane

*Attorney, Agent, or Firm*—Howard Kaiser

[57] ABSTRACT

An electro-rheological fluid composition is provided. A dielectric oil has a particulate mixed therein. The particulate consists essentially of a polymeric sponge material entrapping an electro-rheological constituent such as water. The particulate is sized to remain in suspension when mixed in the dielectric oil.

4 Claims, No Drawings

ELECTRO-RHEOLOGICAL FLUID COMPOSITION HAVING POLYMERIC SPONGE PARTICULATES

The invention described herein may be manufactured and used by or for the Government of the United States of America for governmental purposes without payment of any royalties thereon or therefor.

FIELD OF THE INVENTION

The invention relates generally to electro-rheological fluids, and more particularly to an electro-rheological fluid composition that reduces the complexity of mixing such fluids.

BACKGROUND OF THE INVENTION

Electro-rheological fluids are slurries composed of a non-conducting fluid medium and a particulate. The particulate is responsive to a high-voltage electric field applied across small gap (1–2 mm) electrodes placed in the fluid. The reaction by the particulate effectively changes the viscosity of the fluid in the localized area between the electrodes.

The particulate typically consists of a carrier and an electro-rheological constituent which is responsive to the applied electric field. In order for the effective change in viscosity to remain uniform over time, it is necessary to keep the particulate in suspension within the fluid. However, prior art particulates have been limited in the amount of electro-rheological constituent that they can contain. This results in the use of relatively large particulate (on the order of 100 microns) being introduced into the non-conducting fluid medium. Large particulate require continuous mixing in order to keep the particulate uniformly suspended in the fluid. In addition, large particulate may cause various fluid filters to clog during the use of the electro-rheological fluid.

SUMMARY OF THE INVENTION

Accordingly, it is an object of the present invention to provide an electro-rheological fluid composition that reduces the complexity of mixing a particulate therein.

It is a further object of the present invention to provide an electro-rheological fluid composition having a particulate mixed therein that achieves a high ratio of electro-rheological constituent volume to overall particulate volume in order to reduce the amount of particulate needed.

Still another object of the present invention is to provide an electro-rheological fluid composition in which the particulate is not a contaminant.

Other objects and advantages of the present invention will become more obvious hereinafter in the specification and drawings.

In accordance with the present invention, an electro-rheological fluid composition is provided. A dielectric oil has a particulate mixed therein such that the particulate is between 20–50% by weight of the electro-rheological fluid composition. The particulate consists essentially of a polymeric sponge material entrapping an electro-rheological constituent such as water. The polymeric sponge material exists as 10–30 micron diameter beads having a calculated cross-linking density in excess of 10%. The constituent remains entrapped in the polymeric sponge material when mixed in the dielectric oil.

DETAILED DESCRIPTION OF THE INVENTION

The preferred embodiment electro-rheological fluid composition will be described in terms of a hydrous electro-rheological fluid. Hydrous electro-rheological fluids are slurries composed of a non-conducting fluid medium and a particulate having water as its electro-rheological constituent. However, as will be readily apparent to one skilled in the art, the present invention may also be used for anhydrous electro-rheological fluids (i.e., where water is not the electro-rheological constituent).

The non-conducting fluid medium is typically a dielectric oil. By way of example, silicon oil may be used. The particulate mixed in the dielectric oil consists of a carrier and the electro-rheological constituent, i.e., water in this case. The carrier is a micro sponge which is a polymeric bead having a cross-linking density in excess of about 10%. The micro sponge is sold under the trademarks "MICROSPONGE," "POROSPONGE" and "COMMAND RELEASE." One such micro sponge having 22% water by volume entrapped therein during polymerization is available commercially from Advanced Polymer Systems, Inc., Redwood City, Calif., as Part No. CH-196-64-ME. The carrier is sized for suspension in the dielectric oil and for free movement through any equipment filters that may be encountered during processing. Accordingly, a safe range of carrier diameter that meets these criteria is between 10–30 microns. The porous nature of the carrier allows the ratio of electro-rheological constituent volume to overall particulate volume to be maximized.

The polymeric sponge provides the necessary carrier size to group large quantities of liquid molecules with high polar moments (i.e., water) in order to create the necessary chaining effect in the electro-rheological fluid. This was previously not possible since the liquid molecules on their own are not large enough to create the chaining effect. At the same time, the polymeric sponge is small enough to be held in suspension within the dielectric oil. Once initially mixed into the dielectric oil, ambient temperatures and pressures are maintained to prevent the release of the electro-rheological constituent from the carrier.

The advantages of the present invention are numerous. The electro-rheological fluid composition described above requires no special mixing as the particulate sized as disclosed remains in suspension within the dielectric oil. Use of a polymeric micro sponge allows the ratio of electro-rheological constituent volume to overall particulate volume to be maximized as the sponge traps the constituent in its network of pores. Since the particulate does not settle out, filter clogging problems are eliminated. Finally, polymeric sponge materials are inert with respect to dielectric oils and are non-toxic.

Although the invention has been described relative to a specific embodiment thereof, there are numerous variations and modifications that will be readily apparent to those skilled in the art in the light of the above teachings. For example, the polymeric sponge material could be polymerized with other electro-rheological constituents. In addition, more than one constituent could be entrapped in each micro sponge. It is therefore to be understood that, within the scope of the appended claims, the invention may be practiced other than as specifically described.

What is claimed is:

1. An electro-rheological fluid composition comprising a dielectric oil and a particulate mixed therein, said particulate being 20–50% by weight of said electro-rheological fluid composition and consisting essentially of a polymeric sponge material entrapping an electro-rheological constituent, said electro-rheological constituent being liquid having molecules with high polar moments, said polymeric sponge material being inert with respect to said dielectric oil and existing as 10–30 micron diameter beads, each said bead having a network of pores and a calculated cross-linking density in excess of 10%, said electro-rheological constituent having been entrapped in each said network of pores during polymerization of each said bead, wherein said electro-rheological constituent remains entrapped in said polymeric sponge material when mixed in said dielectric oil.

2. An electro-rheological fluid composition as in claim 1 wherein said dielectric oil is silicon oil.

3. An electro-rheological fluid composition as in claim 1 wherein said electro-rheological constituent is water.

4. An electro-rheological fluid composition as in claim 1, wherein said polymeric sponge material is non-toxic.

* * * * *